US006472066B1

(12) United States Patent
Reese et al.

(10) Patent No.: US 6,472,066 B1
(45) Date of Patent: Oct. 29, 2002

(54) LOW SHRINKAGE, UNCRIMPED SHORT-CUT FIBERS FOR USE IN WET LAID NON-WOVEN PRODUCTS AND METHOD FOR MAKING SAME

(75) Inventors: Glen Patrick Reese, Charlotte, NC (US); Gary William Cooper, Charlotte, NC (US)

(73) Assignee: Arteva North America S.A.R.L., Zurich (CH)

( * ) Notice: Subject to any disclaimer, the term of this patent is extended or adjusted under 35 U.S.C. 154(b) by 63 days.

(21) Appl. No.: 09/777,056

(22) Filed: Feb. 5, 2001

(51) Int. Cl.[7] ..... D01F 6/00
(52) U.S. Cl. ..... 428/364; 428/395
(58) Field of Search ..... 428/361, 364, 428/375, 381, 382, 395

(56) References Cited

U.S. PATENT DOCUMENTS

| | | | | | |
|---|---|---|---|---|---|
| 3,416,952 | A | * | 12/1968 | McIntyre et al. | 117/118 |
| 3,452,132 | A | | 6/1969 | Pitzl | 264/290 |
| 3,557,039 | A | * | 1/1971 | McIntyre et al. | 260/29.2 |
| 3,619,269 | A | * | 11/1971 | McIntyre et al. | 117/118 |
| 3,981,807 | A | * | 9/1976 | Raynolds | 252/8.8 |
| 4,007,083 | A | * | 2/1977 | Ring et al. | 162/101 |
| 4,137,181 | A | * | 1/1979 | Hawkins | 252/8.9 |
| 4,179,543 | A | * | 12/1979 | Hawkins | 428/361 |
| 4,294,883 | A | * | 10/1981 | Hawkins | 428/361 |
| 4,639,347 | A | | 1/1987 | Hancock et al. | 264/291 |
| 4,704,329 | A | | 11/1987 | Hancock et al. | 428/369 |
| 4,707,407 | A | | 11/1987 | Clark et al. | 428/361 |
| 4,713,289 | A | * | 12/1987 | Shiffler | 428/361 |
| 5,145,622 | A | * | 9/1992 | Shiffler | 264/103 |

FOREIGN PATENT DOCUMENTS

| | | | | |
|---|---|---|---|---|
| DE | 19546783 | * | 3/1997 | |
| EP | 0125112 | * | 3/1984 | D02J/1/22 |
| GB | 958350 | * | 5/1964 | |

* cited by examiner

*Primary Examiner*—Newton Edwards
(74) *Attorney, Agent, or Firm*—Gregory N. Clements

(57) ABSTRACT

Low shrinkage, short-cut polyethylene terephthalate fiber exhibiting dispersibility suitable for incorporation into wet laid non-woven products is produced through the use of steam-annealing. The preferred fibers exhibit a hot air shrinkage value of less than about 10 percent, have a length of less than 3 inches, and a dispersion index of less than 5.

7 Claims, 1 Drawing Sheet

Figure 1:
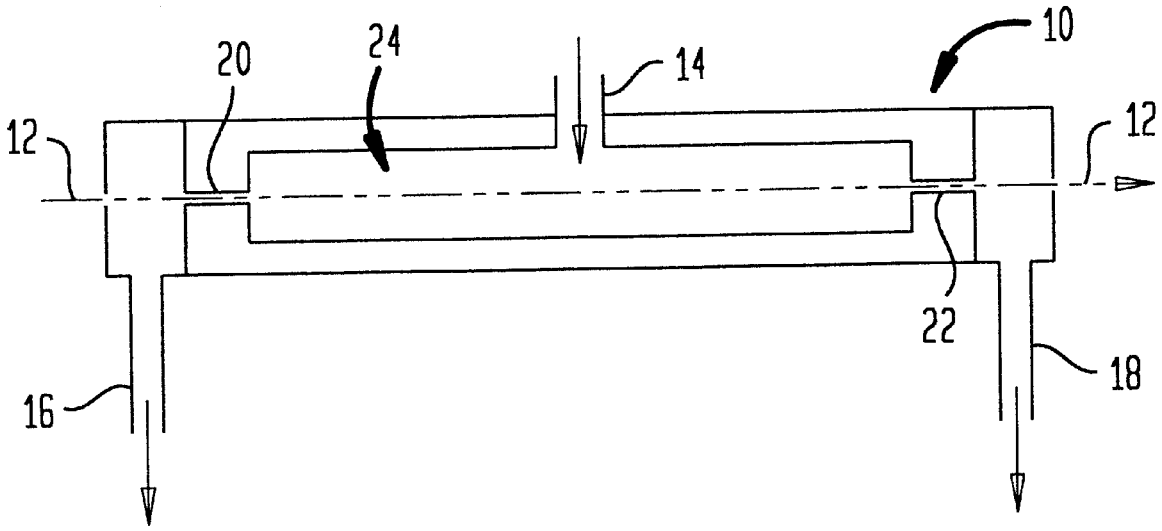

LOW SHRINKAGE, UNCRIMPED SHORT-CUT FIBERS FOR USE IN WET LAID NON-WOVEN PRODUCTS AND METHOD FOR MAKING SAME

TECHNICAL FIELD

The present invention relates generally to polyester fibers and more particularly, in preferred embodiments, to uncrimped, short-cut polyester fibers suitable for incorporation into wet laid non-woven products.

BACKGROUND

Polyester fibers and fiber products for use in textile applications are well known in the prior art. Typically, such polyester fibers are made from polyethylene terephthalate ('PET') polymers by way of multi-step, spin/draw processes. Such processes generally include extruding the PET into a multi-filament tow, drawing the tow of filaments to somewhere between 1.5 and 4 times its original length, and annealing or heat setting the filaments within the tow.

In the production of wet laid non-woven polyester fiber products, the tow is cut into relatively short lengths after being annealed. The short length fibers are dispersed into water and then spread upon a screen. After the water is drained or otherwise removed, the fibers dry to form a wet laid non-woven mat composed of short, intertwined polyester filaments.

The use of polyester fibers for the production of wet laid non-woven products highlights two shortcomings in the traditional production of polyester fiber. First, the individual filaments within the tow tend to adhere to one another and clump together as a result of typical drawing and annealing processes. The clumping is very problematic in the production of wet laid non-woven material since the quality of the non-woven product depends heavily upon the degree of dispersion of filaments within the water.

Second, the individual filaments within the tow tend to deform, or curl, when separated from the other filaments. The deformation occurs due to uneven shrinkage of different filaments within the tow which results from non-uniform annealing of the polyester filaments during the annealing phase of fiber production. Filament deformation adversely affects the production of wet laid non-woven materials because the cut deformed fibers do not intermesh properly when laid upon a screen, resulting in a weakened wet laid non-woven material.

Previous attempts to solve the clumping problems with fiber used in wet laid non-woven. materials have utilized lubricants and other additives to promote the dispersion of the hydrophobic polyester filaments in water. For instance, Shiffler et al., U.S. Pat. No. 5,145,622 discloses a method for improving the dispersibility of polyester fibers by treating them with caustic. In general, the fibers are described as being treated with an appropriate coating as are disclosed, for example, in Hawkins, U.S. Pat. Nos. 4,137,181; 4,179,543; and 4,294,883 and also in U.S. Ser. No. 842,789 filed Mar. 27, 1986 in the names of van Issum and Schluter which discloses the use of a synthetic co-polyester of polyethylene terephthalate units and poly(oxyalkylene) groups derived from a poly(oxyalkylene) glycol having an average molecular weight in the range of 300 to 6,000 as disclosed, e.g. in McIntyre et al., U.S. Pat. Nos. 3,416,952; 3,557,039 and 3,619,269 referred to therein. Other useful segmented co-polyesters are disclosed in Raynolds, U.S. Pat. No. 3,981,807.

Shiffler et al. '622 uses a commercial water dispersible coating (50/50 mixture of potassium salt of mono and diacid phosphate esters of lauryl alcohol/tallow alcohol ethoxylated with 25 moles of ethylene oxide) on fibers having filaments with round and scalloped-oval cross-sections where a higher level of water-dispersible coating was used to offset the scalloped oval's approximately 13% higher surface area. The disclosed coating provided the fibers with favorable dispersion characteristics though the utilization of extended cross-sections and mild crimping taught by Shiffler '622 are not applicable to fibers for use in wet laid non-woven materials.

Similar coatings, which promote dispersion of the short fibers within a water bath, are found in Ring et al., U.S. Pat. No. 4,007,083; Hawkins, U.S. Pat. Nos. 4,137,181; 4,179,543; and 4,294,883; and Viscose Suisse, British Pat. No. 958,350; as well as U.S. Pat. No. 4,713,289 and U.S. Pat. No. 4,707,407. It is noted in the '289 patent that polyester fibers are naturally hydrophobic, so it is necessary to apply a suitable coating to the polyester to overcome the inherent hydrophobic character of the polyester fiber without creating foam or causing the fibers to flocculate.

It is the lubricants and other surface treatments that have distinguished water-dispersible polyester fiber from more conventional polyester fiber, rather than any inherent characteristic of the polyester itself. The prior art has not addressed the effect of actual fiber production on the eventual dispersion of filaments within a water slurry for production of wet laid non-woven materials.

Similarly, traditional methods of annealing polyester fiber do not address the problems of uneven annealing within the tow which causes clumping of chopped filaments. Traditional methods of annealing polyester fibers tend to promote clumping and adhesion between the filaments of the tow. The clumping of the fibers is undesirable because it limits the dispersibility of the fibers within the liquid medium, resulting in the formation of non-uniform wet laid non-woven mats. The precise cause for adhesion is not well understood, but is believed to result, in part, from the sintering of individual filaments to one another during conventional processing, especially during heat-treatment.

The annealing of polyester fiber, and the associated minimization of fiber shrinkage, has conventionally been accomplished by winding the drawn polyester tow around a series of heated rollers. The heated rollers anneal the fibers at a pre-selected temperature. A problem with using heated rollers for annealing polyester fibers is that the rollers only contact a limited number of the polyester filaments within the tow during each pass over a roller, resulting in uneven annealing of the filaments within the tow. Also, the heated roller only contacts one side of the tow during each pass over a roller, with the tow alternately wound through a series of rollers in an attempt to anneal all sides of the tow evenly. The uneven and non-uniform annealing of the fiber results in a fiber which tends to curl. Such unintended deformation of the fibers is detrimental to the production of wet laid non-woven materials.

Many advances having favorable results have been made in the art of heatsetting crimped polyester fiber, but few advances have been made in favorable heatsetting methods for non-crimped fibers used in the production of wet laid non-woven material. At this point, it should be noted that methods of producing uncrimped fibers for use in wet laid non-woven materials are analogous to, but very distinct from methods for producing fibers which will be crimped.

As mentioned above, the production of a high quality wet laid non-woven material depends on the production of polyester fibers having filaments which do not clump together when dispersed in a liquid medium and which do not deform once separated from the tow. Both clumping and deformation depend on the manner in which the fibers are drawn, annealed, and treated after annealing.

The quality of crimped polyester fibers, on the other hand, does not vary depending on clumping or deformation. Crimped fibers are used mostly for production of woven and knit textiles. Crimped fibers are traditionally extruded, drawn, and annealed using the same methods as fibers for use in wet laid non-wovens, but fibers produced for woven and knit materials are subsequently mechanically crimped, cut, carded, and then spun into thread, either alone or in combination with cotton or other fibers. Filament adhesion has little or no effect on a crimped fiber because the step of mechanically crimping the fiberbreaks apart any adhered filaments. The action of carding the crimped fiber further separates any clumped filaments from one another.

Steam treatment has been used in place of heated rollers for the annealing of polyester fibers which are later crimped. However, steam treatment has not been used to reduce clumping within a non-crimped polyester tow during annealing. For instance, U.S. Pat. Nos. 4,704,329 and 4,639,347 to Hancock et al. and corresponding European Patent No. 0125122 describe a method of utilizing saturated steam to anneal drawn polyester filaments in the production of crimped fiber, with the steam-annealed filaments having an improved balance of strength and shrinkage properties. However, Hancock '329 utilizes the steam process in the production of crimped fibers, and therefore does not address the problem of clumping in fibers for use in wet laid non-wovens.

Another steam treatment device is described in German Patent Specification DE 195 46 783 C1, in most detail in connection with FIG. 4 thereof. The device disclosed in the '783 document includes an expansion nozzle feeding a treatment channel wherein the steam accelerates to supersonic speed. The steam decelerates to subsonic speed in the treatment channel before encountering a second nozzle which again accelerates the steam to supersonic velocity. The patent does not discuss clumping within the tow of fiber.

Another method for steam treating polyester fibers is disclosed in U.S. Pat. No. 3,452,132 to Pitzl, wherein a method of heat-treating polyethylene terephthalate yam by applying a steam jet thereto is described. Pitzl impinges the steam jet upon a tow in order to separate the filaments within the bundle and to heat the filaments somewhat instantaneously so that the tow may be uniformly drawn. Pitzl also notes that steam of increased temperature may be used to anneal the polyester fiber. However, the Pitzl process does not address the problems of clumping during the annealing process step, and further involves the use of steam in a combined drawing and annealing process, requiring specialized drawing equipment as well as specialized annealing equipment.

Despite advances in annealing and treatment of polyester fibers, the production of high-quality wet laid non-woven materials is still hampered by the problems associated with polyester fiber deformation and clumping. It has been found in accordance with the present invention that it is possible to make readily dispersible, low shrinkage, uncrimped short cut fibers that overcome the problems of deformation and clumping when used in the production of wet laid non-woven materials.

SUMMARY OF INVENTION

There is provided in a first aspect of the invention, low-shrinkage, short-cut polyethylene terephthalate ('PET') fibers exhibiting dispersibility suitable for incorporation into wet laid non-woven products. The invented fibers have a hot-air shrinkage value of less than about 10 percent and a length of less than about 3 inches. Further, the invented fibers exhibit a dispersion index of less than 5. The fibers are prepared by annealing at an elevated temperature of at least about 165° C. exclusively through the use of steam. The invented fibers are for use in the production of wet laid non-woven materials, and are therefore uncrimped.

There is provided in another aspect of the present invention, a method of preparing low-shrinkage, short-cut PET fibers exhibiting dispersibility suitable for incorporation into wet laid non-woven products and having a hot air shrinkage value of less than about 10 percent resulting in minimal fiber deformation when dispersed within a liquid medium. The fibers are prepared by annealing at an elevated temperature through the use of steam in a multi-step production process having the following steps: (a) melt-extruding a tow of PET; (b) drawing the filaments to impart orientation thereto; (c) heat-setting the drawn filaments at an elevated temperature through the use of steam, the elevated temperature being at least about 165° C.; (d) applying a finish to the tow of filaments; and (e) cutting the tow to a fiber length of 3 inches or less.

BRIEF DESCRIPTIONS OF DRAWINGS

The invention is described in detail below with reference to the various figures in which:

FIG. 1 is a schematic diagram showing a steam treatment chamber used to heat set a flat tow-band array of PET fibers in accordance with the present invention.

DETAILED DESCRIPTION

The invention is described in detail below for purposes of illustration only. Obvious modifications will be readily apparent to those who are skilled in the art within the spirit and scope of the present invention which is set forth in the appended claims.

There is provided in accordance with the present invention a low-shrinkage, short-cut polyethylene terephthalate ('PET') fiber exhibiting dispersibility suitable for incorporation into wet laid non-woven products. The invented fiber exhibits superior dispersion characteristics, with minimal inter-filament bonding.

The invented fiber exhibits a hot air shrinkage value of less than about 10 percent, such shrinkage being uniform so as to result in minimum fiber clumping when dispersed into a liquid medium. The invented fiber preferably has a hot air shrinkage value of less than about 8 percent. Because of uniform annealing, the invented fiber exhibits uniform shrinkage, resulting in minimal clumping of the invented fibers upon shrinking. Since clumped filaments do not disperse uniformly in a wet laid non-woven process, the invented non-clumping fibers with uniform shrinkage produce superior non-woven materials.

The invented fiber also has a very low percentage of filaments which are sintered to one another during the annealing process. The invented fiber is composed of annealed filaments which are not bound to one another during the annealing process, and therefore readily disperse within a liquid medium prior to being processed into a wet laid non-woven material. The preferred embodiment of the invented fiber exhibits a dispersion index of less than 5.

The short-cut PET fiber according to the present invention has a length of less than about three inches and preferably has a length of less than about 1 inch. The invented fibers are greater in length than about ⅛ of an inch and more preferably have a length of at least about ¼ inch. The fibers thus have a length of from about ⅛ inch to about 3 inches, with a preferred length of about 14 inch to about 1 inch.

There is also provided in accordance with the present invention a method of preparing the invented fibers which entails melt-extruding a tow of polyethylene terephthalate filaments and drawing the tow to impart orientation thereto in accordance with well known methods of producing polyester fiber. According to the present invention, the polyester fiber is then subjected to heat setting of the drawn tow at elevated temperatures through the use of steam, the elevated temperature being at least about 165° C. After the steaming process, a lubricant is applied to the tow and the tow is cut into fibers of appropriate length.

Referring now to FIG. 1, a preferred apparatus 10 for use in the invented method of steam-annealing a tow of fibers indicated generally at 12 is shown. The apparatus 10 has a steam inlet 14 and a pair of steam outlets 16, 18. There is further provided an inlet orifice slit 20 and an outlet orifice slit 22. The apparatus 10 defines a treatment chamber 24 which communicates with steam inlet 14, steam outlets 16, 18, as well as with inlet orifice slit 20 and outlet orifice slit 22. The width and length of chamber 24 is chosen to match the tow thickness and residence time required at the process speed. Chamber 24 has a clamping system producing on the order of 200,000 pounds in order to counteract the steam pressure. To minimize the leakage of steam from the apparatus 10, slits 20 and 22 are relatively narrow; with a gap height of from about 0.5 mm to about 2.0 mm being preferred, with a gap height of about 1.0 mm being most preferred.

According to the invented method, the tow of PET is annealed through the use of steam. In a preferred embodiment, an apparatus such as apparatus 10 is used, with steam fed to chamber 24 through steam inlet 14 and preferably exhausted or recycled through steam outlets 16, 18. The steam is preferably fed as saturated steam which condenses on the fibers and rapidly transfers its heat of condensation to the fibers. The condensation of the steam uniformly wets and heats the filaments within the tow band. In general, the pressure in the treatment chamber is from about 10 psig to about 300 psig, corresponding to temperatures from about 115° C. to about 215° C.

The tow 12 is fed through slits 20, 22 in a preferred embodiment as a flat, relatively planar, tow band array having a thickness of from about 0.1 mm to about 1.0 mm. The width of the tow band will be a function of the denier of the tow.

The tow band may be fed at a variety of speeds through the chamber; typically at speeds from about 20 meters/min to about 500 meters/min such that residence times within the chamber 24 are from about 0.2 seconds to about 2.0 seconds. Preferably, the residence time within the steam treatment chamber 24 is about 1 second. Inasmuch as the purpose of the chamber is to heat-treat the fibers, only a light tension is employed, and there is substantially no draw nor relax employed in this step. It should be noted the conventional roll heat setting requires much longer exposure times and the pressure steam method is, by comparison, quite rapid.

The fibers are in most cases coated with a finish after the steaming process to aid in dispersion of the filaments within the water medium. Finishes useful for facilitating the dispersion of polyester fibers within a fluid solution are commonly known in the art. Preferred finishes include those described in Hawkins, U.S. Pat. No. 4,294,883, which describes various ethoxylated emulsifiers that aid in the dispersion of fibers in an aqueous medium.

The short-cut PET fibers according to the invention have a hot air shrinkage value of less than about 10 percent, and preferably less than 8 percent. Wet laid non-woven materials produced with the invented fibers having a hot air shrinkage value of less than about 10 percent result in significantly improved wet laid non-woven properties, while wet laid non-wovens produced with the invented fibers having a hot air shrinkage value of less than about 8 percent have still better properties than the wet laid non-wovens produced with the fiber having 10 percent shrinkage.

In general, the fibers in accordance with the present invention exhibit a hot air shrinkage value of less than about 8 percent which is achieved by operating at a saturated steam pressure between about 150 and 200 psig. Because of the low shrinkage and the relatively uniform shrinkage of the fiber due to the uniform annealing caused by the steam, PET fibers produced in accordance with this invention deform less than PET fibers produced using traditional methods of production and therefore provide greater utility for use in formation of wet laid non-woven materials.

The steam heat treatment of the short cut PET fibers produced in accordance with this invention prevents the individual filaments of the tow from clumping together to any appreciable extent during the heat treatment process. Because, the filaments are not joined, fused, or otherwise bonded together during steam annealing, as they are during heat treatment using hot rollers, the filaments are easily dispersed into a liquid medium for the further production of wet laid non-woven materials As used in the above description, and as further used in the examples and claims, measurement of hot air shrinkage (HAS%) is performed on yams or tows, to determine the length reduction that occurs when the fibers are exposed to dry heat without restraining forces. The test is described in ASTM designation D2259-96. Briefly, an original length of fiber is measured while the tow or yam is under sufficient tension to remove any bulk or crimp, i.e. 0.05 grams/denier. The initial measured length of fiber is recorded as $L_0$. The tension is removed, and the sample is then exposed to dry heat at a temperature of 204° C. for a period of 30 minutes. After cooling and conditioning, the fiber sample is again tensioned to a level of 0.05 grams/denier and its length is again measured and recorded as $L_1$. The hot air shrinkage percentage is expressed as $$\%\ shrinkage = \frac{L_0 - L_1}{L_0} \cdot 100$$

As used in the above description, and as further used in the examples and claims, measurement of dispersion of filaments within a fluid is performed on samples of short-cut fibers, to determine their dispersibility in water. A 1500 ml beaker is filled with clean, room temperature water to a level of 1200 ml. A 2 gram sample of shortcut fibers is dropped into the water, and the mixture is stirred with a glass or plastic rod for 10 seconds. The beaker is then placed against a black background, and the number of undispersed fiber bundles is counted and recorded, with the number of undispersed fiber bundles defined as the dispersion index. A lower number dispersion index is preferred.

EXAMPLES

In the examples which follow, the tow band is heat set in a flat array, using saturated steam, with the flat array generally having a thickness of from about 0.1 mm to about 1.0 mm, and more generally from about 0.2 mm to about 0.5 mm.

Example 1

Spun fibers were prepared by melt spinning a 0.62 IV PET polymer through 1422 hole spinnerets at 89.4 pounds/hr, at a spinning temperature of 290° C., and a spinning take-up speed of 2883 feet/min. Threadlines from 48 packs were combined to form a tow of 68,256 filaments. These filaments were drawn at a ratio of 3.7:1 to form a drawn towband consisting of 1.35 dpf filaments.

The towband was maintained at a tension of about 1 gram per denier as it passed through the steam chamber 10 illustrated in FIG. 1. The treatment length between the inlet and outlet was about 700 mm, and fiber, was passed through the chamber at a speed of 21 meters/min corresponding to a residence time within the chamber of 2 seconds.

Saturated steam was supplied to the chamber, and the pressure within the chamber was varied from no steam up to 230 psig. Samples were collected at different pressures, and tested for hot air shrinkage according to the method described earlier. The relationship between the treatment pressure and the residual hot air shrinkage is depicted in Table 1.

TABLE 1

| Steam Pressure (psig) | Residual HAS (%) |
|---|---|
| Control (no steam) | 17.0 |
| 65 | 11.4 |
| 130 | 9.9 |
| 195 | 8.4 |
| 230 | 7.5 |

as shown above, heat treatment of the PET fiber with steam reduced the residual hot air shrinkage of the fiber, with heat treatment with higher pressure steam resulting in fiber having lower residual hot air shrinkage.

Example 2

A towband formed as in Example 1 was treated in the steam chamber 10 of FIG. 1 at different speeds, corresponding to different residence times within the saturated steam. Tension was maintained at about 1.5 grams/denier. All samples were made at a steam pressure of 200 psig. The relationship between residence time and residual shrinkage is depicted in Table 2.

TABLE 2

| Treatment Time (sec) | Residual HAS (%) |
|---|---|
| Control (no steam) | 15.2 |
| 0.25 | 12.8 |
| 0.3 | 7.0 |
| 0.5 | 7.0 |
| 1.0 | 7.2 |
| 1.5 | 7.9 |
| 2.0 | 5.6 |

As shown above, increase of the residence time of the fiber within a steam heat treatment chamber reduced the residual shrinkage of the fiber, but residence times greater than about 0.3 seconds have only a small additional benefit.

Example 3

A first towband was processed as in Example 2 at a saturated steam pressure of 205 psig (200° C.) and a speed of 50 meters/min corresponding to a residence time of 0.8 sec in the steam. The tow was sprayed with a 5% emulsion of a finish to give a 0.5% Finish On Yarn (FOY) level, and the tow was cut into lengths of 0.5 inch and the dispersion test was performed to count the number of undispersed bundles.

A second towband was processed with the same process speed as the first towband, but the heatsetting was performed by passing the second towband in serpentine fashion around the periphery of 14 consecutive steel rollers of 10 inch diameter, each heated to 200° C. The total contact time against the rollers was 5.2 sec. This method corresponds to the conventional method of heatsetting. The measured hot air shrinkage rate of the second towband was about 8%. The tow was sprayed with a 5% emulsion of a finish to give a 0.5% Finish On Yarn (FOY) level. The tow was cut into 0.5 inch lengths and the dispersion test was performed.

Various finishes were tested, including ethoxylated emulsifiers containing at least 5 mols of ethylene oxide, and having a surface tension of at least 30 dynes per centimeter in a 0.10 weight percent solution at 25° C. in accordance with the disclosure of U.S. Pat. No. 4,294,883. Such emulsifiers include, without limitation, ethoxylated castor oils, ethoxylated hydrogenated castor oils, ethoxylated sorbitol esters, ethoxylated coconut oils, and the like. Other finishes, such as the Cirrasol TM family of finishes from Uniqema, showed the same results as the ethoxylated emulsifiers listed above.

The fibers produced with the disclosed steam annealing process and treated with the disclosed finishes each had a dispersion index of less than 5, typically 0–3. The fibers produced with traditional hot rollers and treated with the disclosed finishes each had a dispersion index of greater than 25.

The fibers which were heat treated using steam exhibited a much lower dispersion index than fibers having similar hot air shrinkage, but heat treated using traditional heated rollers.

While the invention has been described in detail with numerous examples, various modifications will be readily apparent to those of skill in the art. Such modifications are within the spirit and scope of the present invention which is set forth in the claims which follow.

What is claimed is:

1. A low-shrinkage, short-cut polyethylene terephthalate fiber suitable for incorporation into wet laid non-woven products, consisting of:

a plurality of fibers, exhibiting a dispersion index of less than 5.

2. The short-cut polyethylene terephthalate fiber according to claim 1, wherein said filaments have a hot air shrinkage value of less than about 10 percent; and, said filaments have a length of less than about 3 inches.

3. The short-cut polyethylene terephthalate fiber according to claim 2, wherein said fiber has a length of less than about 2 inches.

4. The short-cut polyethylene terephthalate fiber according to claim 3, wherein said fiber has a length of less than about 1 inch.

5. The short-cut polyethylene terephthalate fiber according to claim 4, having a length of at least about ⅛ inch.

6. The short-cut polyethylene terephthalate fiber according to claim 5, having a length of at least about ¼ inch.

7. The short-cut polyethylene terephthalate fiber according to claim 2, wherein said fiber exhibits a hot air shrinkage value of less than about 8 percent.

* * * * *